US007525036B2

(12) United States Patent
Shotwell et al.

(10) Patent No.: US 7,525,036 B2
(45) Date of Patent: Apr. 28, 2009

(54) GROOVE MAPPING

(75) Inventors: Franklin Minor Shotwell, Madison, WI (US); Peter Haller, Avon Lake, OH (US); Matthew Miller, Madison, WI (US); Matthew Allen Logan, Madison, WI (US); Matthew Liang Chaboud, Madison, WI (US)

(73) Assignees: Sony Corporation, Tokyo (JP); Sony Pictures Entertainment, Inc., Culver City, CA (US)

( * ) Notice: Subject to any disclaimer, the term of this patent is extended or adjusted under 35 U.S.C. 154(b) by 270 days.

(21) Appl. No.: 11/095,397

(22) Filed: Mar. 31, 2005

(65) Prior Publication Data

US 2006/0075887 A1 Apr. 13, 2006

Related U.S. Application Data

(60) Provisional application No. 60/618,411, filed on Oct. 13, 2004.

(51) Int. Cl.
*G10H 1/40* (2006.01)

(52) U.S. Cl. ..... 84/611; 84/645

(58) Field of Classification Search ..... 84/611, 84/612, 635, 636, 609
See application file for complete search history.

(56) References Cited

U.S. PATENT DOCUMENTS 5,920,025 A * 7/1999 Itoh et al. ..... 84/611
5,962,802 A * 10/1999 Iizuka ..... 84/609
6,307,141 B1 * 10/2001 Laroche et al. ..... 84/636
6,653,545 B2 * 11/2003 Redmann et al. ..... 84/615
7,078,607 B2 * 7/2006 Alferness ..... 84/609

OTHER PUBLICATIONS

"Beat Detection Engine™", downloaded Oct. 4, 2004, 4 pp. http://www.motu.com/products/software/dp/features/beat-detection.html.

"Hot News, Now Shipping: Pro Tools 6.0 Software", downloaded Oct. 4, 2004, 3 pp. http://www.digidesign.com/news/hotnews/PTv6/index.cfm.

Ernest Cholakis, "What are DNA Groove Templates", *Numerical Sound,* 5 pp, Copyright 1999.

"Editing Grooves", downloaded Oct. 4, 2004, 2 pp. file://\\md-emc\EngPublic\Doc\ACID _5_Help\SRC\Editing Grooves.htm.

"Creating Grooves", downloaded Oct. 4, 2004, 2 pp. file://\\md-emc\EngPublic\Doc\ACID _5_Help\SRC\Creating_Grooves.htm.

"Applying or Removing Grooves", downloaded Oct. 4, 2004, 3 pp. file://\\md-emc\EngPublic\Doc\ACID _5_Help\SRC\Grooves-Applying or Removing.htm.

(Continued)

*Primary Examiner*—Jeffrey Donels
(74) *Attorney, Agent, or Firm*—Mayer & Williams PC; Mark D. Wieczorek, Esq.; Karin L. Williams, Esq.

(57) ABSTRACT

The invention provides a method and software for the adjustment of properties of media streams and events, principally timing information, based on a template, i.e., a groove map. The invention further provides methods by which the templates can be created, edited, and arranged within the context of the media they influence.

29 Claims, 5 Drawing Sheets

OTHER PUBLICATIONS

"Grooves: Overview, Working with Grooves", downloaded Oct. 4, 2004, 1 page. file://\\md-emc\EngPublic\Doc\ACID _ 5_Help\SRC\Grooves-Overview.htm.

"What is Feel and A Brief Background on the DNA Groove Template Concept", Downloaded Oct. 4, 2004, 5 pp. http://www.numericalsound.com/dnagrvin.html.

* cited by examiner

GROOVE MAPPING

CROSS-REFERENCE TO RELATED APPLICATIONS

This application claims priority to and is a continuation-in-part of U.S. Provisional Patent Application Ser. No. 60/618,411, filed Oct. 13, 2004, which is incorporated by reference herein in its entirety.

FIELD OF THE INVENTION

The invention relates to digital audio music, and in particular to methods and software for modifying the groove of a song file.

BACKGROUND OF THE INVENTION

Musical timing is based on a regular grid of beats and measures, and most music creation software acknowledges this by providing a fixed musical grid that helps users align musical events to the musical grid. Editing and creating music in software is made much easier by providing this grid of measures, beats, and subdivisions of beats, and by allowing editing operations to easily snap to the same. However, when the music is rigidly aligned to a grid, the finished composition may have a stiff, robotic feel.

In music that is being or was performed, experienced musicians know how to intentionally stray from this grid, playing certain beats early, and others late, and by doing so create a distinctive "feel" or "groove" to their music. To some extent, this application of "groove" has been available to electronic musicians. For example, "swing" and "shuffle" are simple timing transformations that have been available to electronic musicians in the past. But more complex transformations have remained unavailable.

Another disadvantage to the use of prior musical grids are that the media used within a project are not always well-"quantized". Quantization refers to the placement of notes in precise positions and patterns, based on an ideal musical grid. As a result, if the events that contain the media are snapped to the musical grid, the notes and rhythms within the event will not necessarily synchronize well with the contents of other events in the project. One solution for non-quantized music is to "quantize" the contents of events to an "ideal" musical grid. As before, however, this removes much of the human feel of the musical content as it was originally produced.

Prior attempts to modify the above, sometimes called "groove timing", have generally involved the above as applied either to an entire project or to individual tracks or source media.

Other modifications have involved applying a simple or complex groove to be applied to event data. Such a transformation may be performed in several ways. First, the event's contents may be transformed, such as by rewriting to a new media file or a virtual file. Next, the event may be split into smaller events, some or all of which are shifted in time. Finally, a number of selected events may have their position shifted on the timeline.

Another prior attempt at groove timing involved adjusting the timing of audio data, such as to apply swing, shuffle, or quantization, with "time stretching" algorithms that subdivide the audio into tiny segments, and either inserting silence, inserting repeated portions of the audio stream, inserting cross-fading of adjacent portions of the audio, or combinations of the above.

And another attempt at groove timing involved the creation of "groove templates". These are generally produced by professionals, as the detailed timing variations which comprise a "human feel" are often subtle and are not easily perceived in isolation, although they may be pronounced when heard in the context of a complete piece of music. However, the creation of groove templates is difficult because the tools employed for doing so are unwieldy and, amongst other limitations, do not provide interactive feedback on what effect each adjustment to a template will produce when applied to musical material.

In the above attempts to modify the groove of a media file, the media file itself is generally the subject of the modification. That is, in some prior attempts, the application was a one-time destructive process because applying the groove altered the underlying musical data. As a result, if the user desires to remove or undo the groove, or apply a different groove, the media file must be modified again, back to its original form, which may or may not be possible. There is no convenient way to reversibly test the application of a groove to a media file, or alternatively to apply a groove without altering the underlying media file.

SUMMARY OF THE INVENTION

In general, the invention allows flexibility in all stages of extracting, creating, and applying groove map timing changes for music creation and editing, as well as in allowing users to apply groove maps in a similar manner to the way in which media events are created and edited within their compositions, thereby minimizing the learning curve for such techniques.

In more detail, certain embodiments of the invention allow "groove quantization templates" which capture the timing patterns of human musicians, e.g., drummers, and which are then applied to audio and MIDI data. An "intrinsic" groove is thus defined that can be altered to create any number of grooves for a particular audio file. The groove may be applied over an entire track or just a portion thereof, and different grooves may be disposed on different parts of the same track.

Embodiments of the current invention allow groove maps, also just called rooves, to be applied non-destructively to media. In particular, the underlying musical composition of beats and pulses is not changed; however, an "overlying" groove or groove template adjusts just for that track and only over a specified length of music, which may be an entire track length, a portion thereof, or even just a single pulse. Of course, if desired, a user may change a media file's inherent groove by rendering to a new track. The non-destructive application of grooves to media means that the nature of the grooves can be altered subtly or drastically simultaneously to the playback of the project, so that a user can immediately hear the effects of their changes, and thus achieve more desirable results.

Advantages of certain embodiments of the invention allow groove maps to be applied and arranged in a project in a manner similar to that of the way media is arranged in the project—as easily editable events on a timeline. In this way, a variety of different groove maps can be active on any number of tracks, for any desired duration.

Further advantages of certain embodiments of the invention allow groove maps to alter both the timing of project events and the timing of the contents of those events, so that the same grooves can be applied to full loops of pre-recorded audio and MIDI, as well as to the positioning of single-note "one-shot" events, or tiny snippets of audio on the timeline.

Even more advantages of certain embodiments of the invention allow groove maps to be represented within a groove editor in such a way that the relationship between "pre-groove" time and "post-groove" time is clearly shown. This may be via a deformed grid of diagonal lines, mapping from one timeline to another, and such that the mapping can be easily modified by adjusting the location in time of "pre-groove" and "post-groove" marker handles independently.

Even more advantages of certain embodiments of the invention allow the creation and use of "beat marker" information embedded within and associated with media files to store that media's intrinsic groove map. Using this information, media that contain such information may have groove maps applied more accurately to it. In so doing, compensation is first made from the media's own timing variations, i.e., quantizing the same to the "ideal" musical grid, and then the groove map's timing transformation is applied to adjust the media's contents to the desired variations from the ideal quantized grid.

Other advantages will become apparent from the following description, including the figures and claims.

DETAILED DESCRIPTION

A groove refers to the rhythmic pattern of a piece of music. When a user wishes to apply timing changes to achieve a "human feel" in a sound file as discussed above, or for that matter to remove a "human feel", the user may choose a groove map to apply to the sound file. The groove map may be chosen from a "groove pool", which provides a set of choices of different groove maps.

A user may work with groove pools and maps in a number of different ways. In any case, groove maps may be applied in a similar manner to the way in which media events are created and edited within their compositions.

Figure 1:
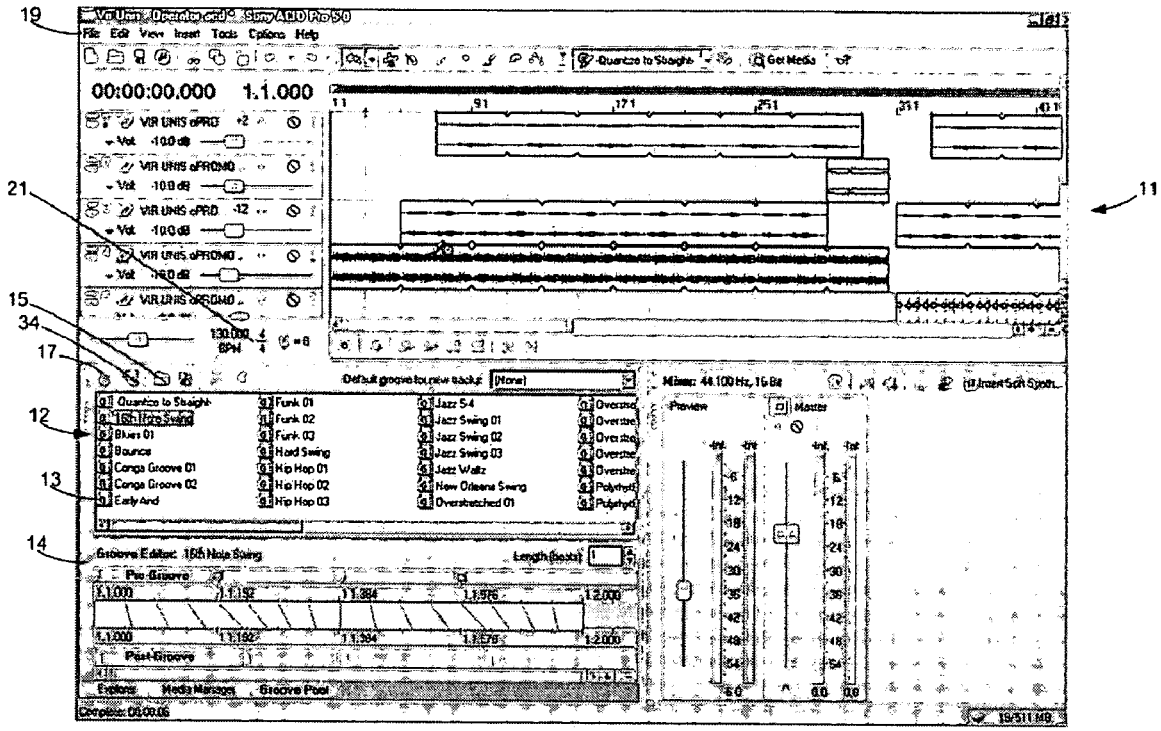
FIG. 1 shows a screenshot of a project according to an embodiment of the present invention, showing a groove pool and groove editor.

For example, referring to FIG. 1, a groove pool or selection of available groove maps 12 may be provided when a user creates a new project or works on a current project, shown in FIG. 1 as project 11. These grooves or groove maps 12, exemplified in this description by groove map or groove 13, may be created in a number of ways, including via provided default groove maps or via custom grooves created by a user. The user may choose from the available selections which groove map, such as groove map 13, would be most appropriate or otherwise desired.

A groove map file 13, whether default or created by a user, may be imported into the project 11. This may occur via a "FILE OPEN" dialogue using menu item 19, an "IMPORT" button 15 in the groove pool window, or by dragging and dropping a groove map file in a "media explorer", which may be similar to WINDOWS EXPLORER but which is focused on media files.

Figure 2:
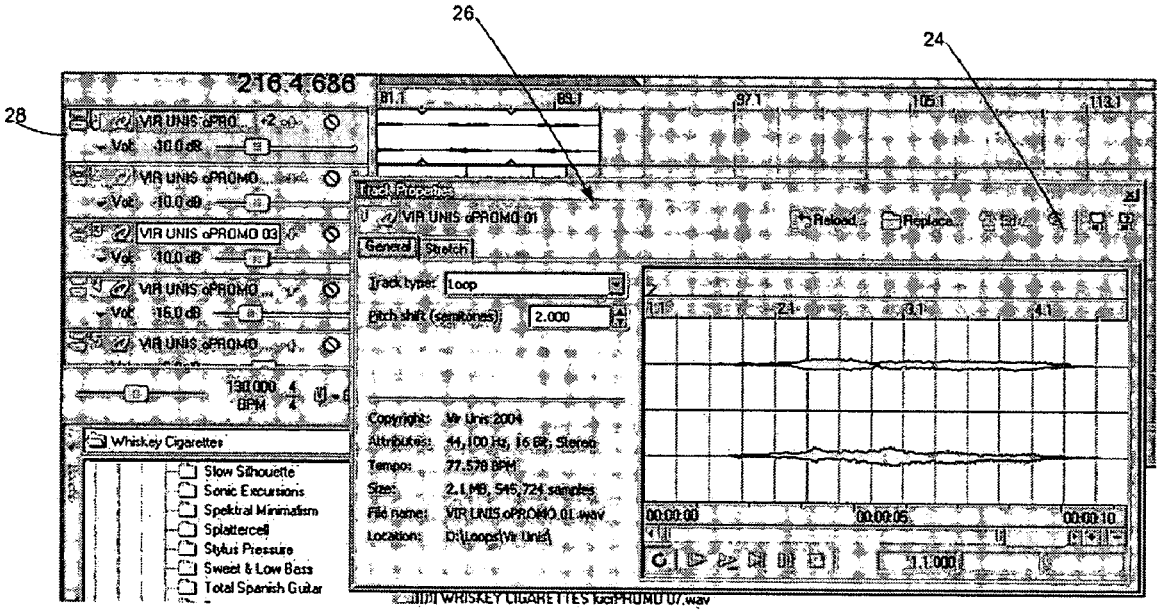
FIG. 2 shows a Track Properties dialogue box.
Figure 3:
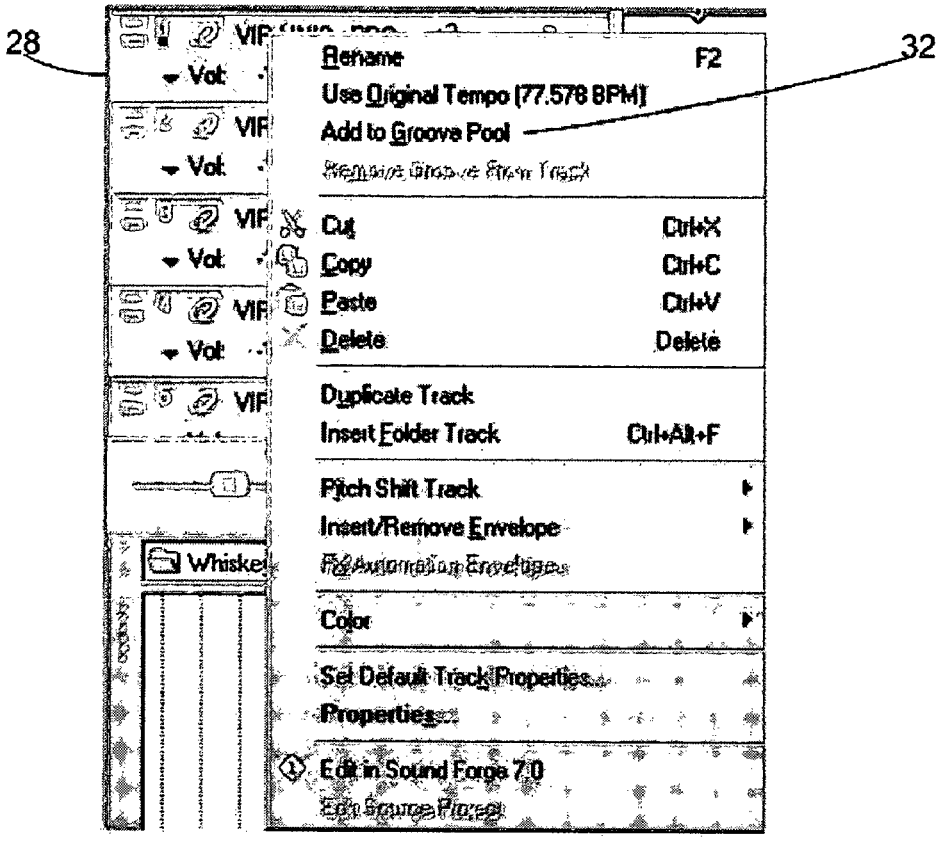
FIG. 3 shows a context menu option from a track header.

Groove map files may also be extracted from audio files and placed in the groove pool via: an "ADD TO GROOVE POOL" button 24 in a track's TRACK PROPERTIES window 26 (see FIG. 2, referring to Track 1 denoted by reference numeral 28), a technique termed herein "groove cloning"; a context menu option 32 from a track header (see FIG. 3); or by dragging an audio media file from the media explorer or WINDOWS EXPLORER into the groove pool.

Groove extraction can be described with respect to several parts. These include extracting a groove from an audio file, determining beat markers, quantizing the groove to an ideal musical grid, and re-grooving.

With regard to the first, during extraction, the length of the audio media is used to approximate the number of beats present in the audio file, and then the audio signal is analyzed in order to identify the strongest beats. Once the positions in the file that are to be considered beats are determined, the software determines which locations in idealized quantized time these beats should correspond to. Then, a time displacement value is associated with each beat. This creates the 'intrinsic groove' or 'beat markers' described elsewhere. The data generated by this process is not always ideal, and can be adjusted by the user in the "Stretch tab" of the "Track Properties" window (see FIG. 8 and accompanying discussion).

Whether via groove extraction or otherwise, every audio file which will have groove mapping applied to it will have its own 'beat markers', which allow the groove mapping transformation to first 'normalize' the timing of the source material, before applying the specific transformation of a given groove.

The conversion of 'beat markers' to a groove map has the aim of taking 'normalized' material, and giving it the timing characteristics of the source audio. Because any audio to be groove mapped will have its own beat markers, the groove mapping engine first 'normalizes' this material, using its own associated beat markers, and then modifies its timing, based on the desired groove map.

Besides groove extraction, the groove pool can be populated in other ways as well. Groove map files can be duplicated within the groove pool, and then modified using groove editor 14 and saved by the user (see button 34 of FIG. 1). Groove map files may also be created from scratch within the groove pool 12 using new groove button 17. For example, users can create their own grooves by simply recording themselves clapping, or by playing any instrument with a unique syncopation.

Each groove map 13 within a groove pool 12 constitutes a data structure that defines the mapping of every point along an ideal timeline, or at least a "prior" or "pre-groove" timeline, to another point in "post-grooved" time. For example, referring to FIG. 4, a "pre-groove" timeline 35 is shown connected by diagonal lines 18 to a post-groove timeline 36. The diagonal lines 18 may represent mappings of specific beats or subdivisions of beats, or may be indicative of what trend the beat-mapping is following at a specific point in time.

The application of a groove generally involves a temporal re-mapping of beats. The software application stretches or time-shifts the audio data as it passes from the media file (as it is read from a hard disk or RAM) to the playback stream. It should be noted that the time-stretching occurs only for loops—for one-shot data or MIDI data, the groove will only affect the start offset.

Pre-groove timeline 35 may be ideal or not, but in any case shows a starting point for the mapping of the timeline which results in the post-groove timeline 36. The beat anchors 46 on the pre-groove timeline 35 map to groove markers 48 on the post-groove timeline 36 via diagonal lines 18. The beat anchors 46 represents the beat that will be adjusted or the source of the groove adjustment. The groove marker 48 represents the point in time when a beat will be played. This is the destination of the groove adjustment, and can occur before or after the beat anchor. The number of anchors and markers may be adjusted depending on the complexity of the groove. As an example, the effect of "slipping" an event may be accomplished by adjusting all beats forward or backward equally, and this may be performed generally by the use of a single beat anchor and groove marker.

Figure 5:
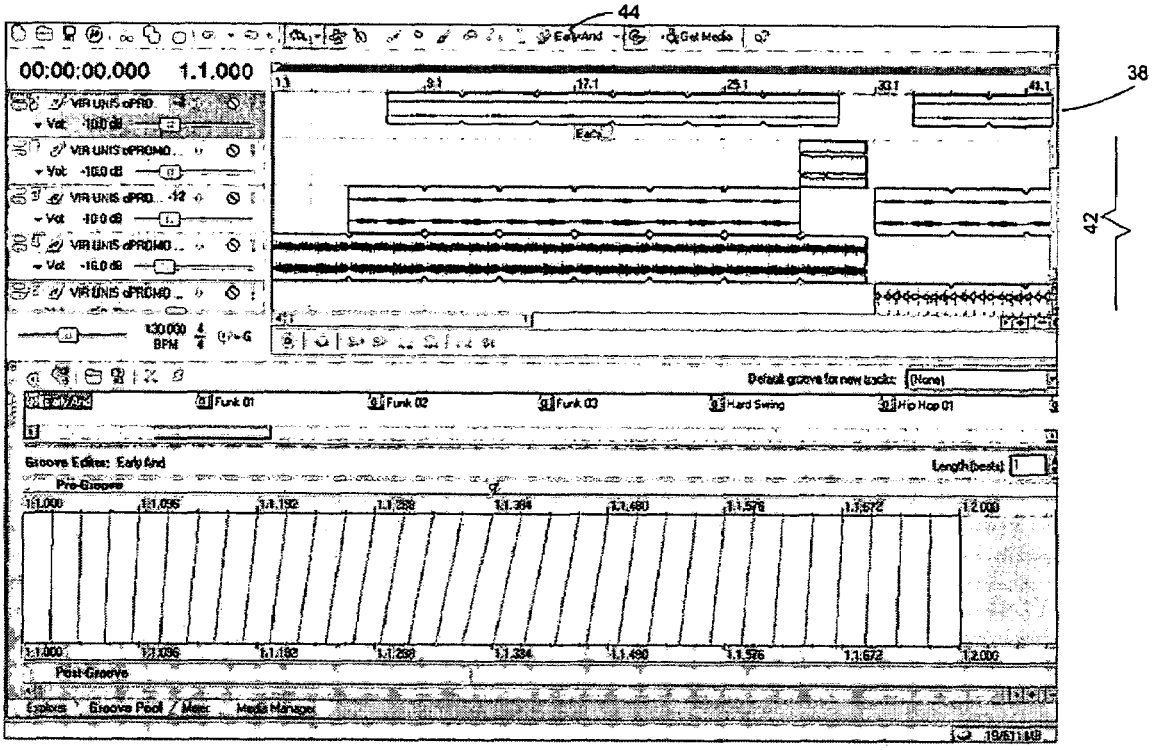
FIG. 5 shows a screenshot of a groove mapping being applied to a single track but not to other tracks.

Referring to FIG. 5, groove maps may be applied to portions of a project by creating groove events directly on the same tracks that hold the source audio and MIDI events. In FIG. 5, a single track 38 is being affected by a groove mapping while the other tracks 42 remain unaffected.

A groove event contains a reference to a single groove map in the groove pool. Any number of groove events can refer to a single groove map. When the groove map's data structure is updated, this modified data becomes that which is employed when each of the groove events transforms the audio or MIDI data it is applied to.

Figure 6:
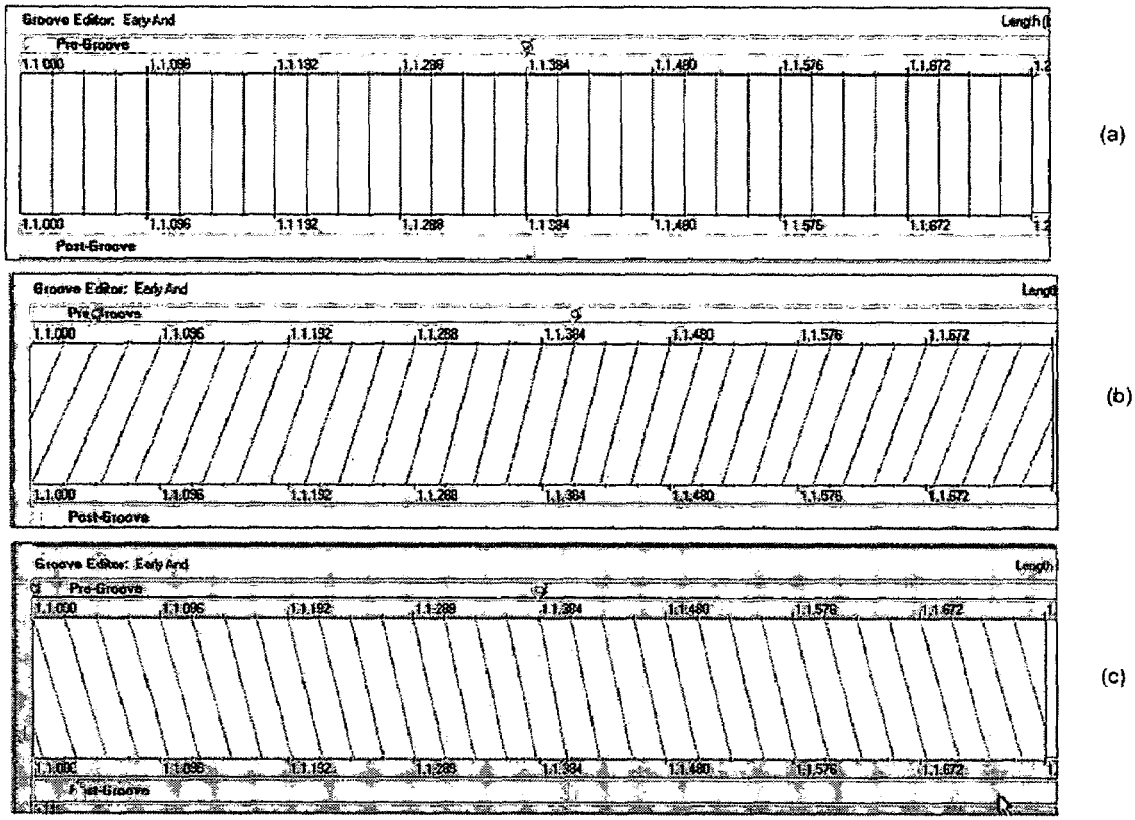
FIG. 6 shows exemplary different types of grooves that may be applied to a project or a portion thereof.

In more detail, referring to FIG. 6*abc,* a flat mapping is shown in FIG. 6*a,* in which no change would be heard. The groove simply applies the identical timing. This mapping is merely shown for contrast, and would not generally be employed. FIG. 6*b* shows a mapping in which each project event occurs somewhat earlier in time than in the pre-groove situation. FIG. 6*c* shows a mapping in which each project event occurs somewhat later in time than in the pre-groove situation.

Figure 7:
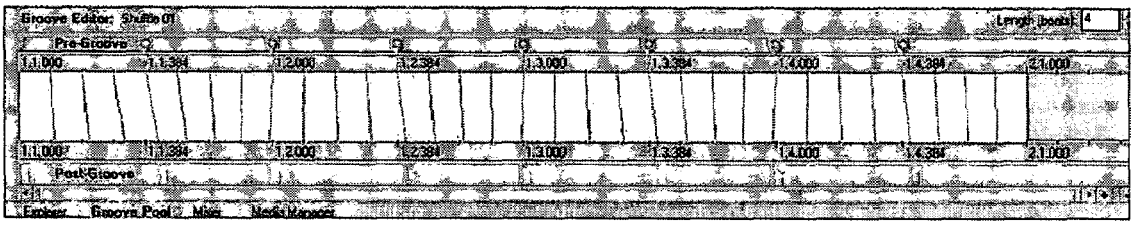
FIG. 7 shows an exemplary types of groove that may be applied to a project or a portion thereof, in particular a shuffle.

Referring to FIG. 7, a more complicated mapping is shown, that of a shuffle. In this case, some of the beats occur early and others late. The overall result is that the music has acquired a "shuffle" groove. Other grooves that may be applied include swing, rock, salsa, reggae, and numerous others, including any number of custom grooves defined by the user.

In a typical groove, certain of the beats or subdivisions of beats (also termed "pulses") are played later or earlier, while others maintain their "ideal" timing or at least are modified in a different way from the others. The way in which the groove transformation is implemented within the software may be uniform; however, the type of audio file determines what processing may have to be performed on the audio file prior to the transformation.

For example, in the multi-track musical composition indicated by reference numeral 11 in FIG. 1, the software program has stored digital information regarding the signal information for each track, as well as the project time signature 21. By the technique of groove extraction described above, by processing the signal for each track, the software program can determine beat markers, which can be altered by the user if desired. Then, employing the groove map chosen by the user, the appropriate peaks can be shifted to new positions according to the groove map. The creation of the 'intrinsic groove' or 'beat markers' may occur automatically for every audio file brought into the software program, which is to have a groove applied.

Beat marker information may be employed to automatically detect beat information. As noted in more detail below, beat marker information is stored within media files, and comprises associations between portions of media time and measures, beats, and beat subdivisions in "ideal" time. In this case, the groove maps may work directly on the previously-identified beats, delaying some and causing other beats to strike early, according to the groove map.

It should be noted that when the music is replayed the output or playback signal represents the musical composition and its modification by the groove map. That is, the underlying musical composition has not been changed; rather, it sounds differently when replayed in conjunction with the groove map. In other words, groove maps are not applied directly to media, but rather to the regions of time on the tracks that hold media. This aspect has a number of beneficial features discussed below, including the important feature that the original sound file is not per se modified and thus no destruction or degradation occurs.

Groove events may be created in a number of ways. One way is by dragging a groove map 13 from the groove pool 12 onto the project timeline, or alternatively to a track header, which may then create a groove event that spans the entire length of the track. Another way is by designating a particular groove map as the 'DEFAULT GROOVE FOR NEW TRACKS", in which case all tracks added to the project will begin with that groove map applied across the entirety of that track. A further way is by "painting" groove events onto the project timeline. With this tool, denoted by button 44 in FIG. 4, users can apply an active groove on whichever media tracks and across whatever time range they desire to be affected.

Figure 4:
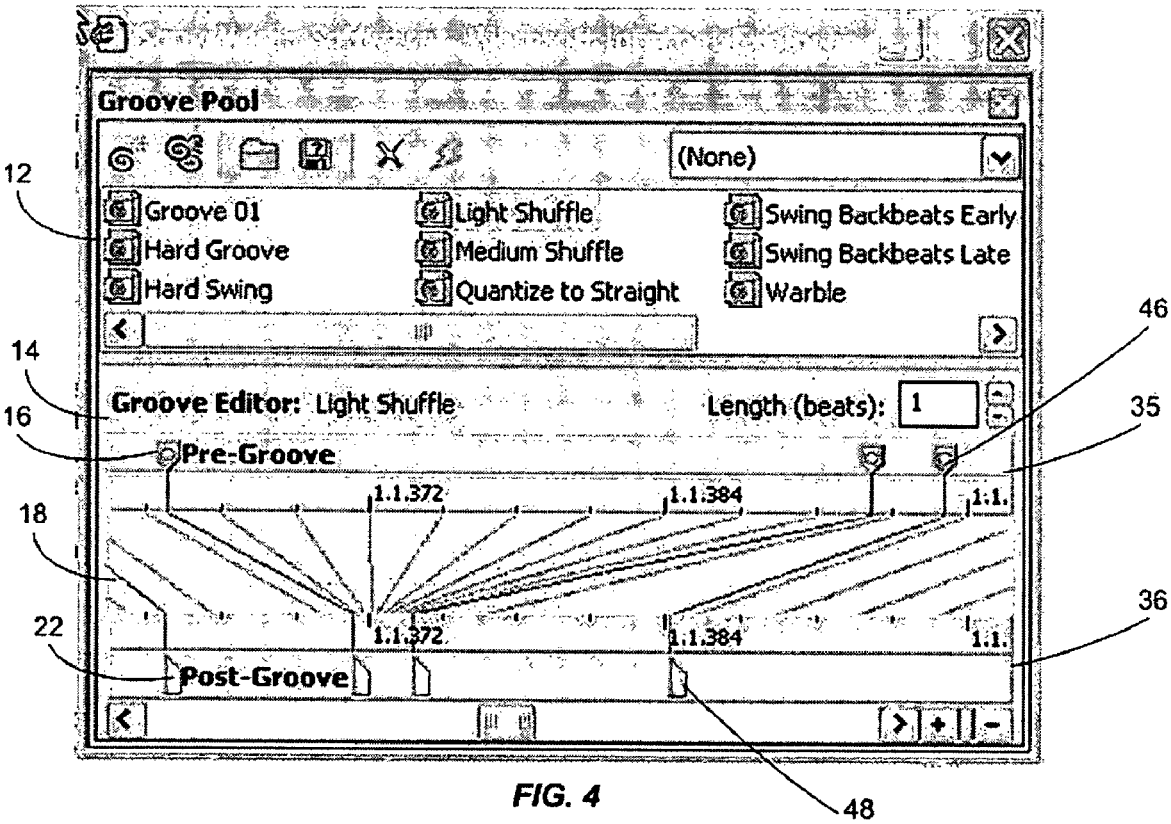
FIG. 4 shows a more detailed view of a project according to an embodiment of the present invention, showing a groove pool and groove editor.

Groove maps may be modified or created using a groove editor 14 (see FIG. 4). As noted above, the groove editor 14 displays how a particular groove map 13 transforms from "ideal" or "pre-groove" timing 34 (in terms of measures, beats, and subdivisions of beats, e.g., pulses such as quarter notes, eighth notes, etc.) to "grooved" timing 36. By adding marker handles 16 and 22, and independently adjusting the "pre-groove" and "post-groove" placement of the marker handles 16 and 22, a user can arbitrarily specify where any segment of ideal time will be mapped when the groove map is applied to the start and length of project events, and to the contents of event media. Diagonal lines 18 may be drawn between the groove markers 16 and 22 in order to help illustrate which portions of the groove map will cause media to be shifted forwards and backwards in time, and which portions will cause media to be played faster or slower.

The groove editor may be particularly effective when the user can immediately hear the results of their actions. This aspect is accomplished by applying a groove to one or more tracks in a project, starting playback of the project, and performing a groove map edit while listening to how those changes affect the final sound of the tracks which have the edited groove map applied. In this way, the user can test several different grooves to determine which sounds best in the user's particular project.

As noted above, groove maps are not applied directly to media, but rather to the regions of time on the tracks that hold media. Thus, the underlying musical composition is not destroyed. It is maintained and if desired a different groove may be attempted with no degradation due to any prior groove attempt. This distinction allows a number of useful applications of groove mapping as follows.

Users can apply the same groove maps to material with rhythmic content, such as looped audio or MIDI files, contained within simple events, and to "one-shot" events whose media is just a single beat or sound, whose rhythms are formed by positioning such events at specific points on the timeline. Users can also apply groove maps to situations which fall between the two extremes—a piece of looping media may be painted in a simple long event with multiple full repetitions of its loop length, and then later in the timeline, small segments or snippets of the same media could be placed on the timeline as events whose contents are just a few beats. Snippets conform to whatever portion of groove is applied to the time where they fall, regardless of where, in the source media, they were extracted. It should be noted in this context that there is no need for cyclical "looping" material to have the same length as the groove maps applied to it, or for that matter to other material which is being groove mapped similarly.

Groove maps may be more versatile and useful if the same can be readily applied to any content, regardless of its original timing. If it was desired to employ a groove map that makes all beats occur a little later than they would in perfect metronome time, then its application should result in the same output audio no matter what the input audio, e.g., whether the input audio source file was perfectly quantized, had beats already played late, or had beats played early. Embodiments of the present invention achieve this in part by the use of "beat markers", noted above, which are automatically detected and user adjustable. Beat marker information is stored within media files, and comprises associations between portions of media time and measures, beats, and beat subdivisions in "ideal" time. Using beat marker information, embodiments of the invention may normalize the timing of imperfectly-timed material before applying a desired groove map. The normalization may be done in such a way as to minimize the amount of "time-stretching" performed, since time-stretched audio can introduce undesirable audio artifacts.

Figure 8:
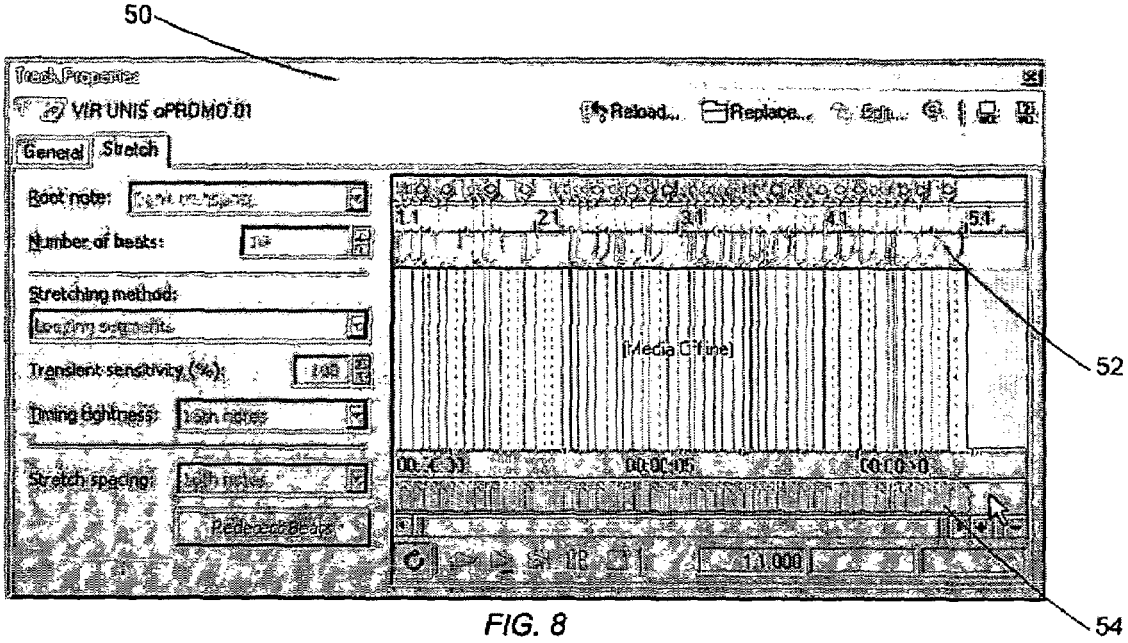
FIG. 8 shows a set of beat markers within an audio track file.

For example, referring to FIG. 8, a set of pre-grooved or intrinsically-grooved beat markers 52 is shown coupled through a groove application to post-grooved beat markers or stretch markers 54 within a TRACK PROPERTIES dialogue 50. To accomplish a normalization or quantization of an intrinsic groove, the beat markers 52 should be set at the appropriate sample within the original recording, to try to match the associated attack. The beat markers may be employed to ensure that stretching changes are performed in locations away from the places where they would be most noticeable.

Then the user matches the stretch marker to the appropriate beat where the recorded beat should play, if it were played in perfect time. If the user then were to select "PLAY QUANTIZED", they would hear the media being stretched to sound as if it would play in perfect synchronization with a perfect metronome. As noted, for one-shots and for MIDI, only the start time would be offset.

After quantization or normalization occurs, the groove editor and groove events may be used to impart a re-grooving to a desired groove.

Through the embodiments described above, groove mapping allows versatility as to how and where grooves are applied, and provides immediate visual and/or audio feedback at any or all of the stages of creating and applying grooves, so that users have as much control as possible over the final results. Applying a groove mapping timing transformation as late as possible, e.g., at playback time, and not at groove application or earlier times, makes possible the modification of groove maps during playback.

Maintaining a pool of available groove maps, and groove events that refer to groove maps in the groove pool, but without storage of individual groove map data, allows users to modify a single groove map and affect numerous tracks simultaneously. Such facility would not be possible if every groove event held its own groove data.

The methods used for adjusting the timing of the contents of media can vary depending on the media. MIDI data is easily stretched in time, as are certain "one-shot" events described above, simply by adjusting the start time of the events. Stretching audio data is more difficult, and may be accomplished with audio time-stretching and time-compressing algorithms, which break up the audio into small segments, and shift, overlap, and fade these segments together. In some embodiments, audio loops may be automatically time-stretched and time-compressed to match a single tempo. Similar algorithms may be used when groove mapping audio loops. Several different stretching algorithms may be employed for each loop-based audio track in a project. The choice of algorithm affects both the stretching to match the project tempo, and the finer-grained stretching used in groove mapping.

Groove maps may also contain information on volume dynamics and timing, so that when applying a groove map, the volume of the source material could be increased or decreased over different ranges of time. This provides the ability for a groove map to accent certain beats more than others.

Groove mapping may be expanded to allow groove maps which cause the segments of affected audio to play out of order, e.g., playing the material from the source media's $4^{th}$ beat at beat 2, and vice-versa, or to play portions of the source material in a reversed fashion.

Pitch changes, filtering to emphasize or attenuate different frequency spectra, and variations in instrument timbre, or other nuanced effects, could be described in groove maps, and then applied analogously to the application of timing adjustments. For example, if a groove adjusts a beat so that it plays early, the pitch may be raised. If a groove adjusts a beat so that it plays later, the pitch may be lowered.

Applying groove maps to video streams would allow for applications in synchronizing the timing of video to music, or synchronizing different video footage with each other. Other video properties could be included in a video groove map, such as color (hue, saturation, luminance, brightness, contrast), camera orientation, focus, motion blurring, etc.

Groove mapping may be refined as an education tool, such as to help train percussionists and other musicians to play with different grooves.

The timing patterns of speech, as generalized to different languages, dialects, or to individual speech patterns, could be treated in a similar manner to the way in which groove mapping is implemented by the invention. A real-time speech groove mapper could be integrated into telephony applications, so that, e.g., a person for whom English is a second language could map their speech to the timing patterns of a native English speaker.

Other alternative uses include the creation of new sounds. For example, drums may sound like talking drums by changing to pitch-shift segments in the stretch type, or musical stuttering may be caused to occur in time with the beat by stretching enough combined with coarse stretch spacing. Users may apply one track against a duplicate, each with slightly different grooves, to achieve musical-sounding flange-combing sounds.

The invention has been described with respect to certain embodiments. However, the invention is not to be limited to those embodiments described; rather, the invention is limited solely by the claims appended hereto, and equivalents thereof.

The invention of claimed is:

1. A method of non-destructively modifying a media file, comprising:

providing a first media file in a first computer memory;

providing a first groove file in a second computer memory;

processing the first media file to determine the existence, location, and content of beat marker information; and playing back the first media file using information in part from the first groove file without destructively modifying the contents of the first media file, wherein said first groove file imparts a variation to contents of the first media file during playback.

2. The method of claim 1, further comprising:

providing a second groove file in a third computer memory; and playing back the first media file using information in part from the second groove file.

3. The method of claim 1, wherein the first media file comprises an audio track.

4. The method of claim 1, wherein the first and second computer memories are implemented in hardware.

5. The method of claim 1, wherein the first media file is chosen from the group consisting of: a full loop of pre-recorded audio or MIDI, a single note or "one-shot" event, and a small "snippet" of audio.

6. The method of claim 1, further comprising using the beat marker information to perform the step of quantizing the first media file to an ideal audio grid prior to the step or playing back the first media file using information in part from the first groove file.

7. The method of claim 1, wherein the first media file is selected from the group consisting of: songs and spoken word files.

8. The method of claim 3, wherein the groove file affects the volume of all or a portion of an audio track.

9. A method of non-destructively modifying a media file, comprising:

providing a first media file in a first computer memory;

processing the first medial file to determine the existence and location of intrinsic or inherent beat information;

providing a first groove file in a second computer memory; and playing back the first media file using information in part from the first groove file without destructively modifying the contents of the first media file.

10. The method of claim 9, further comprising using the beat information to perform the step of quantizing the first media file to an ideal audio grid prior to the step of playing back the first media file using information in part from the first groove file.

11. A method of modifying a media file, comprising:

providing an audio file in a first computer memory, the audio file containing audio information for at least one track of audio;

providing at least one groove file in a disk storage medium;

providing a user interface displaying at least a portion of the audio information for at least one track of audio and further displaying information about the at least one groove file in a disk storage medium;

providing user means for non-destructively applying the at least one groove file to the at least one track of audio, wherein said first groove file imparts a modification to contents of the audio file during playback;

displaying the at least one track of audio to show its apparent modification by the first groove file.

12. The method of claim 11, further comprising playing back the at least one track of audio using information in part from the at least one groove file without destructively modifying the contents of the first media.

13. The method claim 11, further comprising providing at least two groove files in a disk storage medium and further providing user means for choosing one of the at least two groove files to non-destructively apply to the at least one track of audio.

14. The method of claim 13, wherein said at least one track of audio is at least two tracks of audio, and further comprising applying one of said at least two groove files to one of the at least two tracks of audio and another of said at least two groove files to another of the at least two tracks of audio.

15. The method of claim 11, wherein the providing user means for non-destructively applying the at least one groove file to the at least one track of audio includes applying the at least one groove file to an entirety of the track of audio or to a user-selected portion of the track of audio.

16. The method of claim 11, further comprising loading the first groove file into a second computer memory.

17. The method of claim 11, wherein the displaying further comprises changing a display size of the at least one track of audio.

18. The method of claim 11, wherein the displaying further comprises changing a displayed signal structure of the at least one track of audio.

19. A method of displaying how a media file will be non-destructively modified during playback by a groove file, comprising:

providing a groove file in a first computer memory or storage medium, the groove file containing information about how beats of a pre-groove audio track are transformed into beats of a post-groove audio track, wherein said groove file imparts a variation to contents of the pre-groove audio track during playback;

displaying certain beats of the pre-groove audio track along one axis; and displaying certain beats of the post-groove audio track along another axis, the certain beats of the pre-groove audio track corresponding to the certain beats of the post-groove audio track.

20. The method of claim 19, further comprising:

displaying lines between the certain beats of the pre-groove audio track and the corresponding beats of the post-groove audio track.

21. The method of claim 19, wherein the one axis and the another axis are parallel, and wherein the lines are displayed in the area between the two parallel lines.

22. The method of claim 19, wherein the certain beats of the pre-groove audio track are defined by user-modifiable beat anchors, and wherein the certain beats of the post-groove audio track are defined by user-modifiable groove markers, and further comprising: providing means for a user to drag the user-modifiable boat anchors or the user-modifiable groove markers, or both, to define a custom groove.

23. The method of claim 22, further comprising providing means for a user to save a user-created custom groove.

24. A computer program, residing on a computer-readable medium, for displaying how a media file will be non-destructively modified during playback by a groove file, the computer program comprising instructions for causing an apparatus to:

provide a groove file in a first computer memory or storage medium, the groove file containing information about how beats of a pre-groove audio track are transformed into beats of a post-groove audio track, wherein said groove file imparts a variation to contents of the pre-groove audio track during playback;

display certain beats of the pre-groove audio track along one axis; and display certain beats of the post-groove audio track along another axis, the certain beats of the pre-groove audio track corresponding to the certain beats of the post-groove audio track.

25. A method of normalizing and non-destructively modifying a media file, comprising:

providing a first media file in a first computer memory;

adjusting a plurality of beats of the first media file so that the plurality of beats substantially align with an ideal audio grid;

providing a first groove file in a second computer memory, wherein said first groove file imparts a variation to contents of the first media file during playback; and playing back the adjusted first media file using information in part from the first groove file without destructively modifying the contents of the first media file.

26. The method of claim 25, wherein the adjusting includes applying a groove map to the first media file to move a set of predetermined beats to locations substantially aligned with the ideal audio grid.

27. The method of claim 25, wherein the adjusting includes matching beats in the first media file to a set of pre-groove beat markers, and performing time-stretching or time-compression to the matched beats to move the matched beats into alignment with the ideal audio grid.

28. The method of claim 27, wherein the pre-groove beat markers are moved into associated attack locations.

29. A computer program, residing on a computer-readable medium, for normalizing arid non-destructively modifying a media file, the computer program comprising instructions for causing an apparatus to:

provide a first media file in a first computer memory;

adjust a plurality of beats of the first media file so that the plurality of beats substantially align with an ideal audio grid;

provide a first groove file in a second computer memory, wherein said first groove file imparts a variation to contents of the first media file during playback; and play back the adjusted first media file using information in part from the first groove file without destructively modifying the contents of the first media file.

* * * * *

UNITED STATES PATENT AND TRADEMARK OFFICE

CERTIFICATE OF CORRECTION

PATENT NO. : 7,525,036 B2
APPLICATION NO. : 11/095397
DATED : April 28, 2009
INVENTOR(S) : Franklin Shotwell et al.

It is certified that error appears in the above-identified patent and that said Letters Patent is hereby corrected as shown below:

Col. 2, line 42, after “called”, change “roves” to --grooves--.

Col. 3, line 14, after “accurately to”, change “it” to --them--.

Col. 3, line 33, after “groove”, change “mapping” to --map--.

Col. 3, line 37, after “exemplary”, change “types” to --type--.

Col. 5, line 6, before “the beat”, change “represents” to --represent--.

Col. 5, line 7, after “The groove”, change “marker” to --markers--.

Col. 5, line 7-8, before “the point”, change “represents” to --represent--.

Col. 5, line 61, after “program”, delete “,”.

Col. 6, line 4, after “replayed”, insert --,--.

Col. 9, line 23, after “step”, change “or” to --of--.

Col. 9, line 34, after “first”, change “medial” to --media--.

Col. 10, line 50, after “user-modifiable”, change “boat” to --beat--.

Col. 11, line 9, after “substantially”, change “align” to --aligns--.

Col. 12, line 7, after “normalizing”, change “arid” to --and--.

UNITED STATES PATENT AND TRADEMARK OFFICE

CERTIFICATE OF CORRECTION

PATENT NO. : 7,525,036 B2
APPLICATION NO. : 11/095397
DATED : April 28, 2009
INVENTOR(S) : Franklin Shotwell et al.

It is certified that error appears in the above-identified patent and that said Letters Patent is hereby corrected as shown below:

Col. 12, line 12, after “substantially”, change “align” to --aligns--.

Signed and Sealed this

Thirtieth Day of June, 2009

JOHN DOLL
*Acting Director of the United States Patent and Trademark Office*